US008313009B2

(12) United States Patent
Parisi et al.

(10) Patent No.: US 8,313,009 B2
(45) Date of Patent: Nov. 20, 2012

(54) PEPPER SPRAY CONTAINER ASSEMBLY

(75) Inventors: Brian M. Parisi, Evanston, IL (US); Jeffrey D. Anderson, Hampshire, IL (US)

(73) Assignee: Illinois Tool Works Inc., Glenview, IL (US)

( * ) Notice: Subject to any disclaimer, the term of this patent is extended or adjusted under 35 U.S.C. 154(b) by 316 days.

(21) Appl. No.: 12/849,314

(22) Filed: Aug. 3, 2010

(65) Prior Publication Data

US 2011/0049188 A1 Mar. 3, 2011

Related U.S. Application Data

(60) Provisional application No. 61/239,131, filed on Sep. 2, 2009, provisional application No. 61/295,498, filed on Jan. 15, 2010.

(51) Int. Cl.
*B67B 1/00* (2006.01)

(52) U.S. Cl. ..... 222/153.11; 222/162; 222/175; 222/402.1; 222/183; 222/325

(58) Field of Classification Search ..... 222/153.01–153.04, 153.09, 153.11, 153.13, 153.14, 160, 222/162, 175, 182, 183, 192, 325, 402.1, 222/402.11, 402.15, 402.24, 404
See application file for complete search history.

(56) References Cited

U.S. PATENT DOCUMENTS 3,228,565 A * 1/1966 Stanzel ..... 222/82
3,386,631 A 6/1968 Kotuby
3,716,170 A * 2/1973 Mangels ..... 222/162
3,730,390 A 5/1973 Adrian et al.
4,044,922 A * 8/1977 Bordelon ..... 222/183
4,220,263 A * 9/1980 Caruso ..... 222/183
4,223,804 A * 9/1980 Morris et al. ..... 222/3
4,446,990 A * 5/1984 Stevenson et al. ..... 222/82
4,449,474 A * 5/1984 Mariol ..... 116/2
4,454,966 A * 6/1984 Hicks ..... 222/153.11
5,082,137 A * 1/1992 Weinstein ..... 220/345.3
5,169,039 A * 12/1992 Kay et al. ..... 222/509
5,226,563 A * 7/1993 Coggiola ..... 222/95
5,242,349 A * 9/1993 Reiff et al. ..... 482/106
5,310,086 A * 5/1994 Julinot ..... 222/1
5,325,997 A * 7/1994 Washington et al. ..... 222/175
5,366,118 A * 11/1994 Ciammitti et al. ..... 222/153.1
5,373,427 A * 12/1994 McLean ..... 362/96
5,446,985 A * 9/1995 Chen ..... 42/1.08
5,458,263 A * 10/1995 Ciammitti et al. ..... 222/153.1
5,509,581 A * 4/1996 Parsons ..... 222/153.13
5,531,359 A * 7/1996 Winner ..... 222/153.11
5,709,635 A * 1/1998 Denison ..... 482/108
5,842,601 A * 12/1998 Pierpoint ..... 222/1
5,865,348 A * 2/1999 Harding ..... 222/192
5,949,338 A * 9/1999 Masi et al. ..... 340/573.1
6,050,454 A 4/2000 Ludaescher et al.
6,199,726 B1 3/2001 Cardwell, III
6,510,960 B1 * 1/2003 Christopherson et al. . 220/345.3
D470,212 S 2/2003 Cardwell, III et al.
6,929,154 B2 * 8/2005 Grey et al. ..... 222/153.03
(Continued)

*Primary Examiner* — Kevin P Shaver
*Assistant Examiner* — Patrick M Buechner
(74) *Attorney, Agent, or Firm* — Mark W. Croll; Paul F. Donovan

(57) ABSTRACT

A pepper spray container assembly includes a first housing, a second housing secured to the first housing, and a pepper spray bottle securely retained by the first and second housings. A portion of the first housing is configured to be pressed into the assembly and moved forward into an activation position, thereby sliding the first housing forward relative to the second housing.

21 Claims, 12 Drawing Sheets

U.S. PATENT DOCUMENTS

| | | | | |
|---|---|---|---|---|
| 7,140,515 | B2 * | 11/2006 | Cardwell et al. | 222/183 |
| 7,559,439 | B2 * | 7/2009 | Cellini et al. | 222/78 |
| 7,614,526 | B2 * | 11/2009 | Gaillen | 222/162 |
| D619,196 | S * | 7/2010 | Cardwell et al. | D22/117 |
| 7,752,974 | B2 * | 7/2010 | Wenaas et al. | 102/367 |
| 7,815,075 | B2 * | 10/2010 | Simkins | 222/183 |
| 8,031,078 | B1 * | 10/2011 | Liestman | 340/574 |
| 2001/0001202 | A1 | 5/2001 | Cardwell, III et al. | |
| 2005/0103806 | A1 * | 5/2005 | Cardwell et al. | 222/183 |
| 2006/0016833 | A1 * | 1/2006 | Greiner-Perth | 222/383.1 |
| 2007/0062982 | A1 * | 3/2007 | Blum et al. | 222/518 |
| 2009/0120962 | A1 * | 5/2009 | Malorni et al. | 222/153.11 |
| 2011/0210146 | A1 * | 9/2011 | Dapper | 222/113 |

* cited by examiner

PEPPER SPRAY CONTAINER ASSEMBLY

RELATED APPLICATIONS

This application relates to and claims priority benefits from U.S. Provisional Patent Application No. 61/239,131, filed Sep. 2, 2009, and U.S. Provisional Patent Application No. 61/295,498, filed Jan. 15, 2010, both of which are hereby incorporated by reference in their entireties.

FIELD OF EMBODIMENTS OF THE INVENTION

Embodiments of the present invention generally relate to a pepper spray container assembly, and, more particularly, to a pepper spray container assembly that protects against inadvertent engagement.

BACKGROUND

Many law-abiding citizens carry pepper spray devices in order to defend themselves when their safety is threatened. While such situations may rarely present themselves, the possibility of such scenarios is very real. However, while atypical, one rarely, if ever, knows if and when such a situation will arise. Consequently, many believe it is wise to be prepared, even if the possibility of such a threatening situation is remote.

Typically, a pepper spray device is carried in a purse or pocket. In order to activate the device, a user typically aims a nozzle of the device at an assailant and presses a button on the device to eject the pepper spray. However, the button may be accidentally engaged, such as if another item in a purse or pocket is inadvertently urged into the button. Such an inadvertent engagement may cause pepper spray to be discharged within the purse or pocket.

SUMMARY OF EMBODIMENTS OF THE INVENTION

Certain embodiments of the present invention provide a pepper spray container assembly that includes a first housing including an activation button, a second housing secured to the first housing, and a pepper spray bottle securely retained by the first and second housings. The activation button is configured to be pressed into the assembly and subsequently moved forward toward an intended target, thereby sliding the first housing forward relative to the second housing, in order to dispense pepper spray from the pepper spray bottle.

The pepper spray bottle may include a main body and a nozzle portion. The nozzle portion is longitudinally compressed when the activation button is moved forward. The nozzle portion remains longitudinally aligned with respect to a central axis of the pepper spray bottle at all times. That is, the nozzle portion is not bent, pivoted, angled, or the like, with respect to the main body when pepper spray is dispersed.

At least one of the first and second housings may include a detachable key ring.

The first housing may include a safety tab integrally connected to the activation button. The safety tab abuts a wall portion of the second housing in a deactivated position. However, the safety tab is aligned with and slides through a tab slot formed in the wall portion when the activation button is pressed into the assembly and moved forward.

The first housing may include first slider tabs, and the second housing may include second slider tabs. The first and second slider tabs slidably abut one another to secure the first housing to the second housing.

One of the first or second housings may include a lock tab. The other may include a lock tab slot that securely retains the lock tab.

One of the first or second housings may include lock ledges, while the other may include securing ledges that are biased into the lock ledges, thereby securing the first housing to the second housing. At least one of the lock ledges includes a protuberance that prevents at least one of the securing ledges from forward movement when the assembly is in a deactivated position.

The assembly may also include at least one biasing spring between at least one of the first and second housings and the pepper spray bottle.

One of the first or second housings may include a detent. The other may include a reciprocal opening that retains the detent when the assembly is in a deactivated position.

Figure 1:
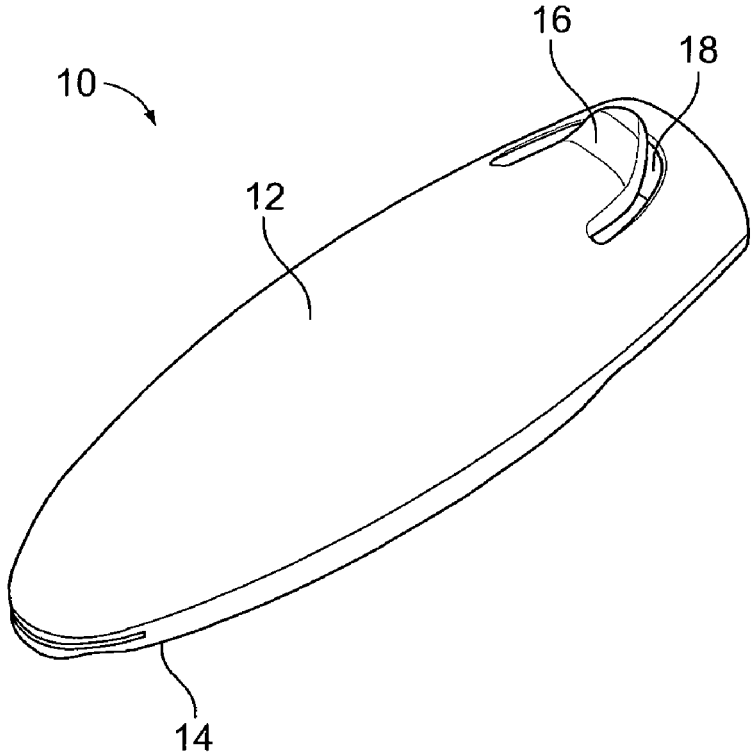
FIG. 1 illustrates an isometric top view of a pepper spray container assembly, according to an embodiment of the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF EMBODIMENTS OF THE INVENTION

FIG. 1 illustrates an isometric top view of a pepper spray container assembly 10, according to an embodiment of the present invention. The assembly 10 includes an upper housing 12 secured to a lower housing 14. A pepper spray bottle (hidden from view in FIG. 1) is contained between the upper and lower housings 12 and 14. An activation button 16 is formed on the upper housing 12. The activation button 16 may be an engageable spring member formed over an opening 18 in the upper housing 12. The button 16 is configured to flex downwardly, about an axis defined by its attachment to the upper housing 12, into and through the opening 18 when pressed. Once pressure is released, the button 16 flexes upwardly back to its at-rest position.

Optionally, the opening 18 may be filled with an elastomeric material, thereby providing a fluid-tight assembly, while still allowing the button 16 to be urged toward an internal chamber of the assembly 10.

Figure 2:
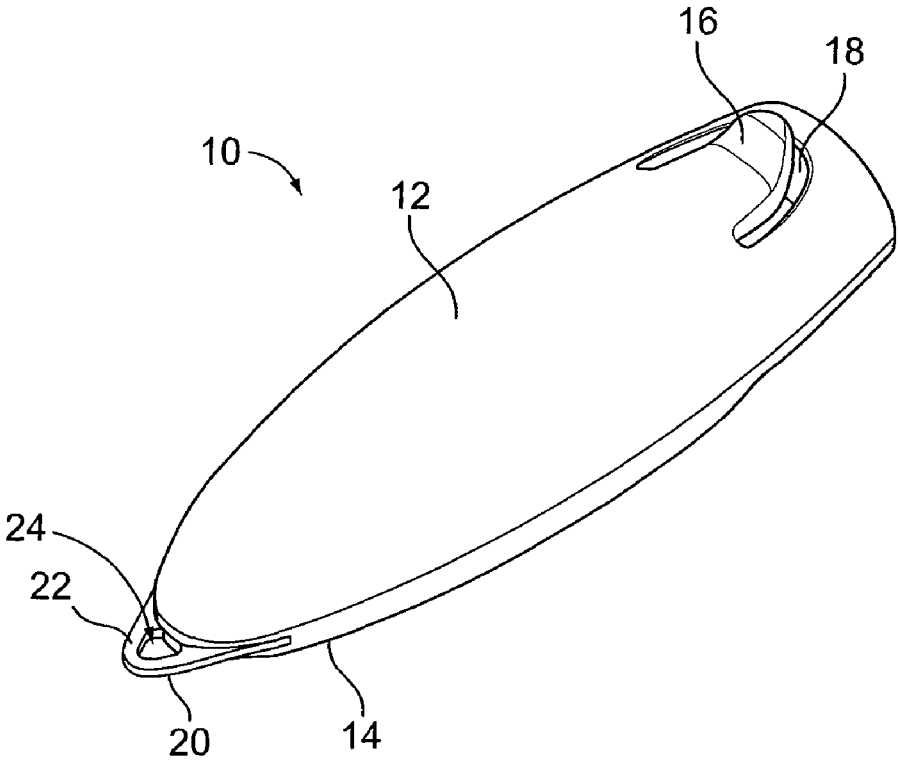
FIG. 2 illustrates an isometric top view of a pepper spray container assembly, according to an embodiment of the present invention.

FIG. 2 illustrates an isometric top view of the pepper spray container assembly 10. The assembly 10 may include a keyring attachment 20 having a loop 22 defining a central passage 24. A key ring (not shown) may securely connect to the assembly 10 by way of the loop 22.

The attachment 20 may snapably secure to a distal end of the lower housing 14, as described below. Optionally, the assembly 10 may include an integrally formed loop that is integrally molded to the lower housing 14. Also, alternatively, the assembly 10 may not include the attachment 20, as shown, for example, in FIG. 1.

Figure 3:
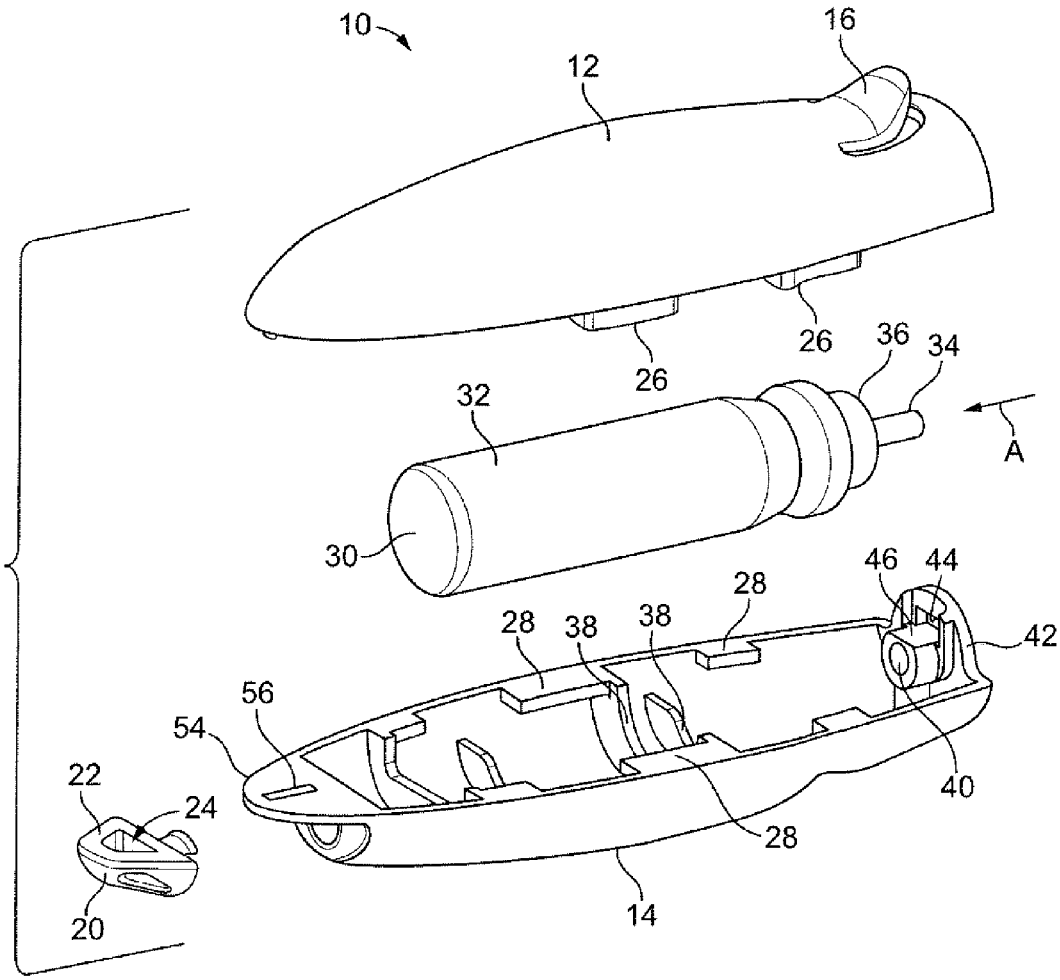
FIG. 3 illustrates an isometric exploded view of a pepper spray container assembly, according to an embodiment of the present invention.

FIG. 3 illustrates an isometric exploded view of the pepper spray container assembly 10, according to an embodiment of the present invention. The upper housing 12 includes a plurality of horizontally-oriented (with respect to the orientation in FIG. 3) slider tabs 26 that extend from interior portions of the upper housing 12. While not shown, the slider tabs 26 may include parallel planar tabs separated from one another by a gap. That is, each tab 26 may include a first planar tab separated from a second planar tab by a vertical beam that is distally located from the outer edges of the housing 12. Thus, a slot or gap may be oriented toward the outer edges between the parallel tabs. A slider tab of the lower housing 14 is configured to be slidably sandwiched between the parallel tabs of the slider tab 26.

At least a portion of each slider tab 26 is configured to be positioned below reciprocal slider tabs 28 extending from upper edges of the lower housing 14. For example, lateral exposed edges of the slider tabs 28 slidably abut into vertical extension beams (not shown in FIG. 3) that project the slider tabs 26 below the slider tabs 28. Because portions of the slider tabs 26 of the upper housing 12 are slidably secured underneath the slider tabs 28 of the lower housing 14, the upper housing 12 is secured to the lower housing 14. As indicated, the slider tabs 26 and 28 are configured to slide with respect to one another.

A pepper spray bottle 30 having a main body 32 that contains pepper spray and a nozzle 34 is secured between the upper and lower housings 12 and 14. The pepper spray bottle 30 is configured to dispense pepper spray when the base 36 of the nozzle 34 is compressed toward the main body 32 in the direction of arrow A.

The lower housing 14 includes a plurality of support ribs 38 that cradle the main body 32. The nozzle 34 of the pepper spray bottle 30 is aligned with a nozzle opening 40 formed at an operative end of the lower housing 14. An arch 42 is formed at the proximal end of the lower housing 14, and the nozzle opening 40 passes through a lower portion of the arch 42. A tab slot 44 is formed over a block 46 that defines the nozzle opening 40.

Figure 4:
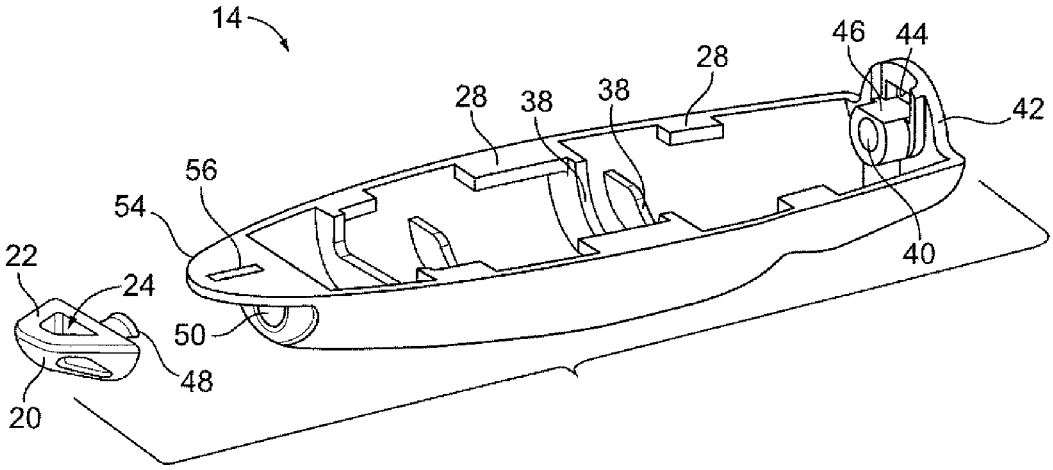
FIG. 4 illustrates an isometric exploded top view of a lower housing according to an embodiment of the present invention.

FIG. 4 illustrates an isometric exploded top view of the lower housing 14. The attachment 20 includes a barb 48 that is configured to snapably secure into a reciprocal opening 50 formed in a distal end of the lower housing 14.

Figure 5:
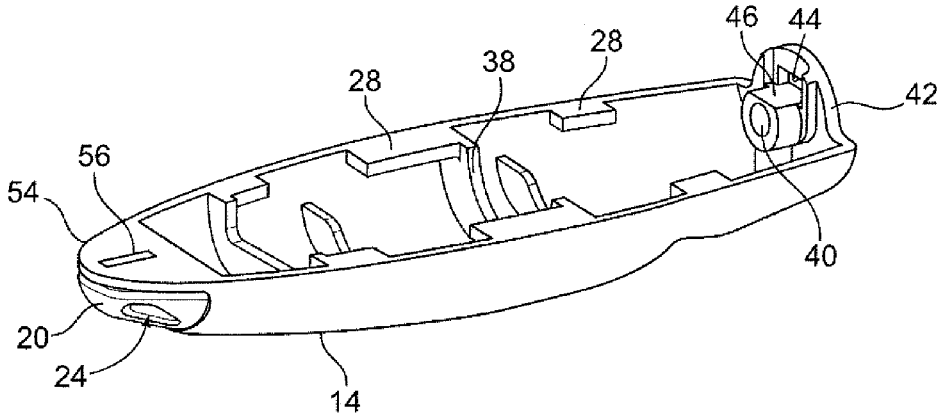
FIG. 5 illustrates an isometric top view of a lower housing according to an embodiment of the present invention.

FIG. 5 illustrates an isometric top view of the lower housing 14 with the attachment 20 snapably secured to the distal end. Again, the attachment 20 is configured to securely fasten a key ring to the pepper spray container assembly 10. Because the attachment 20 is snapably secured to the lower housing 14, the attachment 20 may be quickly and easily removed from the lower housing 14, thereby providing a convenient release mechanism that allows the assembly 10 (shown in FIGS. 1-3) to be removed from a key chain.

Figure 6:
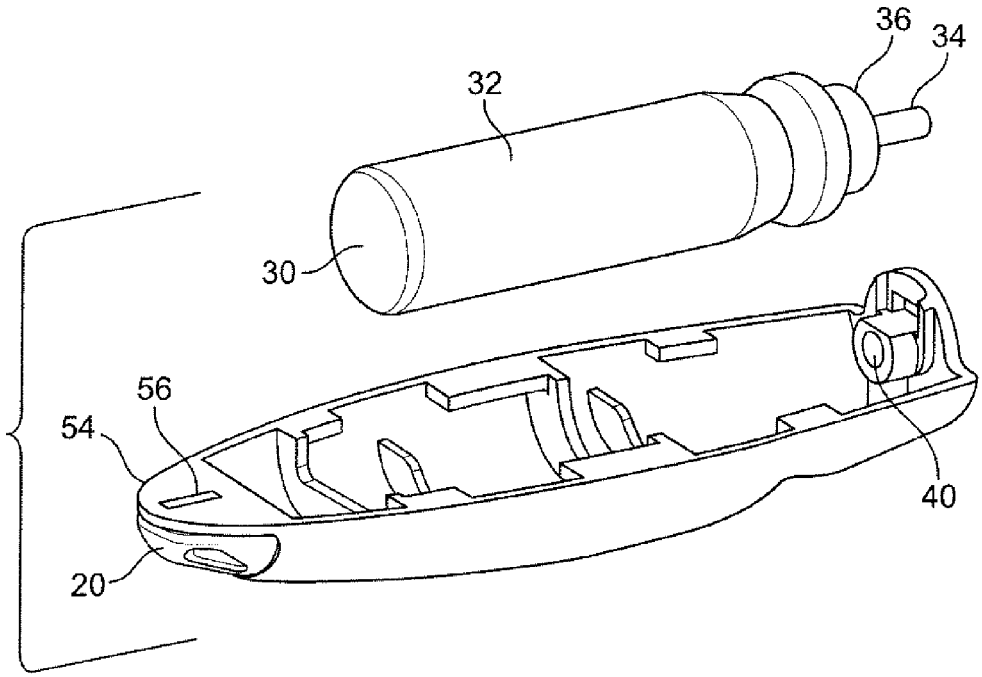
FIG. 6 illustrates an isometric top view of a pepper spray bottle being positioned within a lower housing, according to an embodiment of the present invention.
Figure 7:
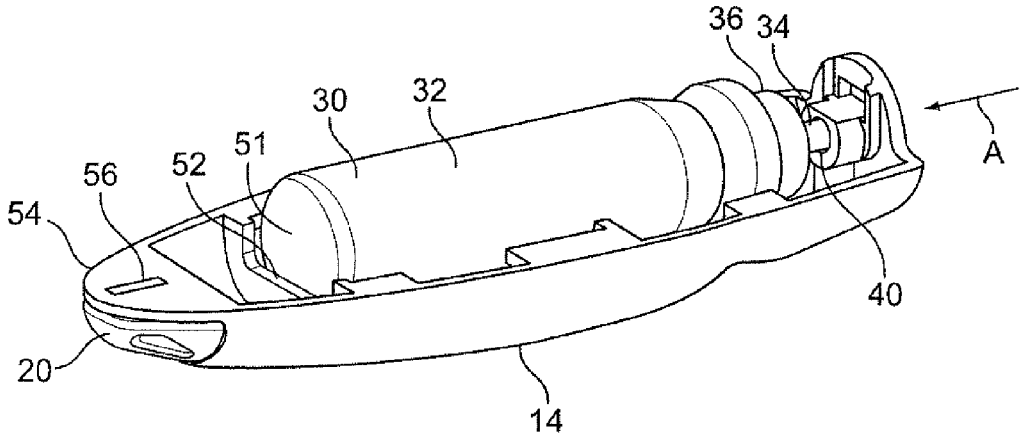
FIG. 7 illustrates an isometric top view of a pepper spray bottle secured within a lower housing, according to an embodiment of the present invention.

FIG. 6 illustrates an isometric top view of the pepper spray bottle 30 being positioned within the lower housing 14. FIG. 7 illustrates an isometric top view of the pepper spray bottle 30 secured within the lower housing 14. Referring to FIGS. 6 and 7, the nozzle 34 is positioned within the nozzle opening 40. A base 51 of the main body 32 abuts against an interior wall 52 of the lower housing 14. The wall 52 prevents the main body 32 from movement within the lower housing 14 in the direction of arrow A.

As shown in FIGS. 3-7, a planar beam 54 extends from upper edges of the lower housing 14 above the attachment 20. A longitudinal slot 56 is formed through the beam 54. The slot 56 is configured to securely and slidably retain a lock tab of the upper housing 12, as explained below.

Figure 8:
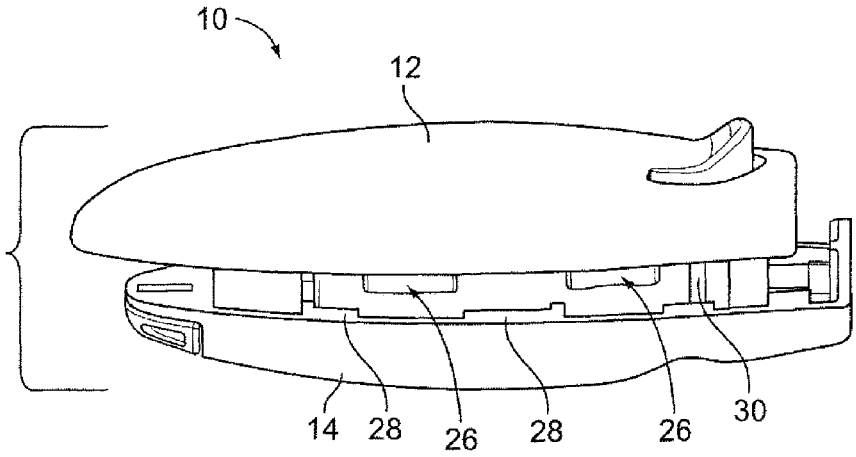
FIG. 8 illustrates an isometric side view of an upper housing being positioned over a lower housing, according to an embodiment of the present invention.

FIG. 8 illustrates an isometric side view of the upper housing 12 being positioned over the lower housing 14, according to an embodiment of the present invention. As noted above, portions of the slider tabs 26 of the upper housing 12 are configured to be positioned below the slider tabs 28 of the lower housing 14. The slider tabs 26 may include parallel tabs separated by a gap. The slider tabs 28 of the lower housing 14 may fit between the parallel tabs within the gap. As such, the slider tabs 28 may be slidably sandwiched between parallel tabs of the slider tabs 26 of the upper housing 12.

Figure 9:
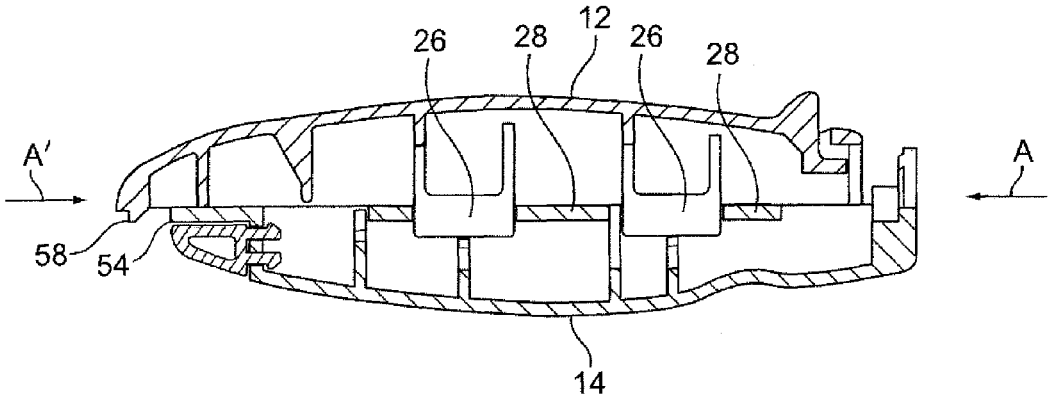
FIG. 9 illustrates a lateral transverse cross-sectional view of an upper housing securing to a lower housing, according to an embodiment of the present invention.

FIG. 9 illustrates a lateral transverse cross-sectional view of the upper housing 12 securing to the lower housing 14. For the sake of clarity, the bottle 30 is not shown. As shown in FIG. 9, portions of the tabs 26 are below the tabs 28. In order to secure the upper housing 12 to the lower housing 14, the upper housing 12 is slid into position in the direction of arrow A'. As such, upper surfaces of the slider tabs 26 of the upper housing 12 slidably abut lower surfaces of the slider tabs 28 of the lower housing 14, thereby ensuring that the upper housing 12 does not eject from the lower housing 14.

Additionally, a lock tab 58 is retained within the slot 56 (shown in FIGS. 3-7) of the beam 54 of the lower housing 14. The retention of the lock tab 58 within the slot 56 prevents the upper housing 12 from shifting off the lower housing 14.

Figure 10:
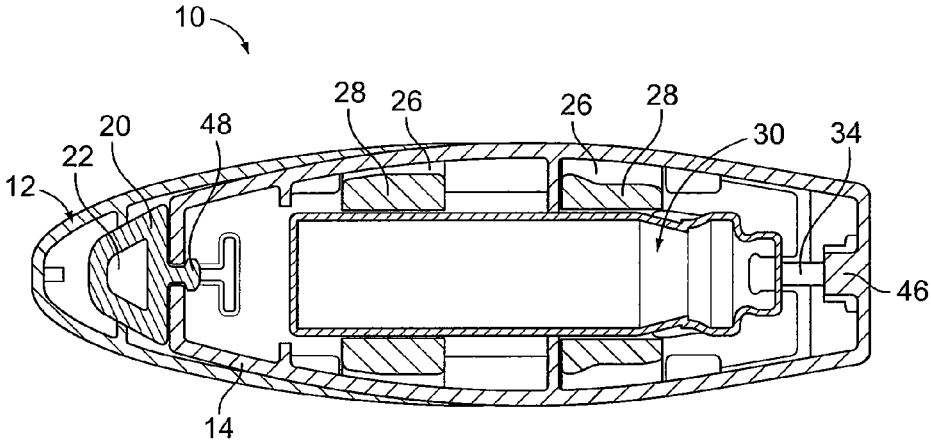
FIG. 10 illustrates a cross-sectional view of a pepper spray container assembly from below, according to an embodiment of the present invention.

FIG. 10 illustrates a cross-sectional view of a pepper spray container assembly from below, according to an embodiment of the present invention. As shown, the slider tabs 28 of the upper housing 12 slidably abut the slider tabs 26 of the lower housing 14.

Figure 11:
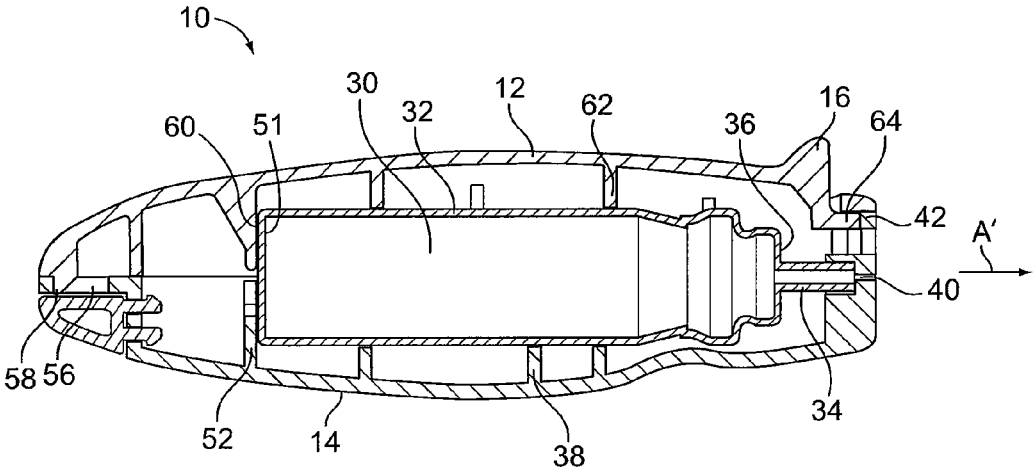
FIG. 11 illustrates a lateral cross-sectional view of a pepper spray container assembly, according to an embodiment of the present invention.

FIG. 11 illustrates a lateral cross-sectional view of the pepper spray container assembly 10, according to an embodiment of the present invention. The pepper spray container assembly 10 is shown in a deactivated, at-rest position. In this position, the interior wall 52 of the lower housing 14 abuts a lower portion of the base 51 of the bottle 30. Additionally, an interior wall 60 of the upper housing 12 abuts an upper portion of the base 51. The main body 32 of the bottle 30 is securely cradled between support ribs 38 of the lower housing 14 and support ribs 62 of the upper housing 12.

The nozzle 34 is secured within the nozzle opening 40 formed through the operative end of the lower housing 14. As shown in FIG. 11, the activation button 16 integrally connects to a horizontal safety tab 64 that is blocked from movement in the direction of arrow A' by the arch 42, just above the tab slot 44.

Figure 12:
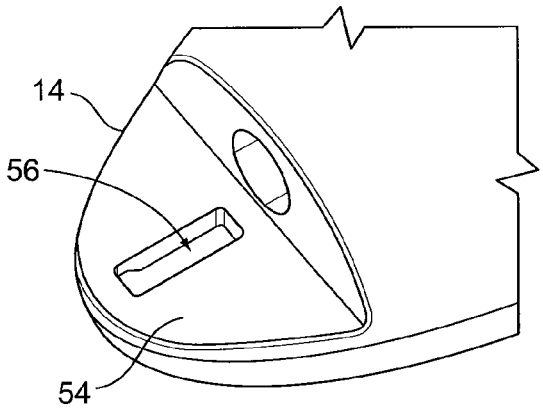
FIG. 12 illustrates an isometric bottom view of a distal end of a lower housing, according to an embodiment of the present invention.

FIG. 12 illustrates an isometric bottom view of a distal end of the lower housing 14. Referring to FIGS. 11 and 12, the lock tab 58 is slidably secured within the slot 56.

Figure 13:
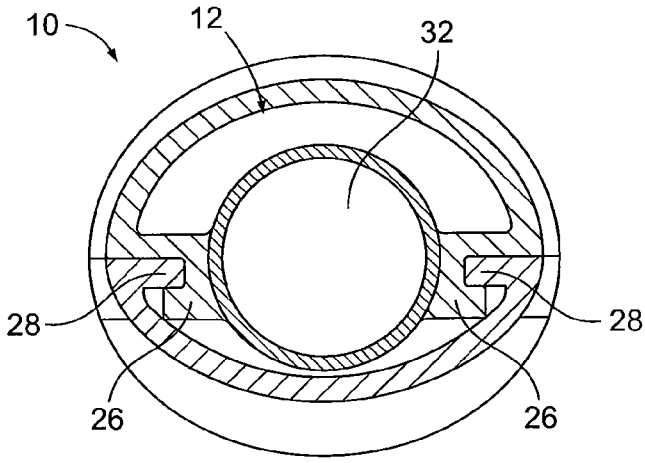
FIG. 13 illustrates an axial cross-sectional view of a pepper spray container assembly, according to an embodiment of the present invention.

FIG. 13 illustrates an axial cross-sectional view of the pepper spray container assembly 10. As shown in FIG. 13, the slider tabs 26 of the upper housing 12 are slidably secured underneath the slider tabs 28 of the lower housing 14, thereby securing the upper housing 12 to the lower housing 14.

Figure 14:
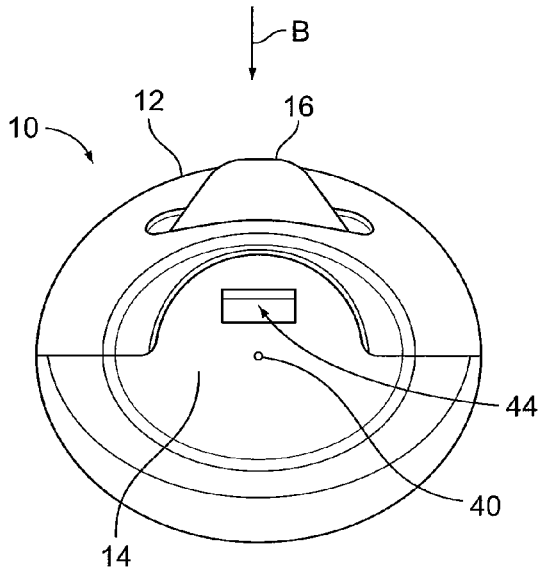
FIG. 14 illustrates a front view of a pepper spray container assembly, according to an embodiment of the present invention.

FIG. 14 illustrates a front view of the pepper spray container assembly 10. As shown, the nozzle opening 40 is below the tab slot 44. In order to activate the dispense pepper spray, the activation button 16 is first pressed down in the direction of arrow B.

Figure 15:
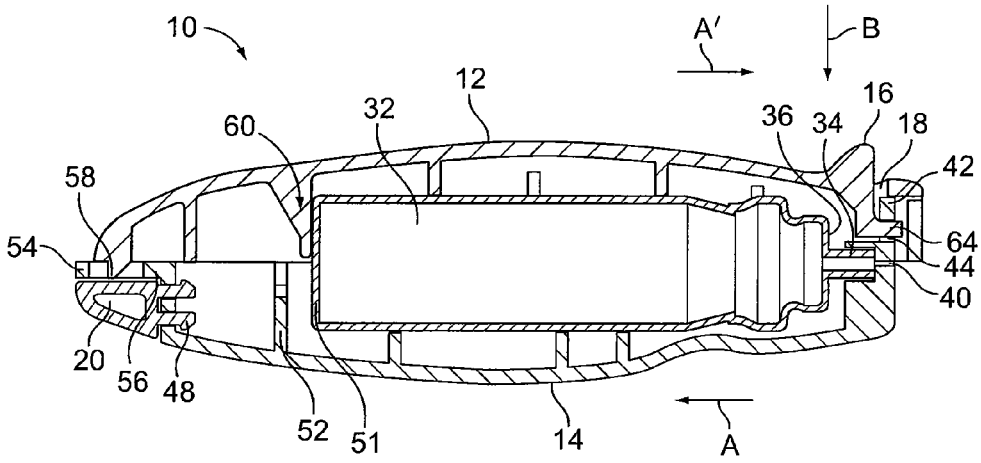
FIG. 15 illustrates a lateral cross-sectional view of a pepper spray container assembly in an activated position, according to an embodiment of the present invention.

FIG. 15 illustrates a lateral cross-sectional view of the pepper spray container assembly 10 in an activated position, according to an embodiment of the present invention. When the activation button 16 is pressed down in the direction of arrow B, the safety tab 64 no longer contacts the arch 42. Instead, the safety tab 64 is aligned with the tab slot 44. Once the safety tab 64 is aligned with the tab slot 44, the activation button 16 is urged forward in the direction of arrow A', thereby moving the upper housing 12 with respect to the lower housing 14. In this manner, the interior wall 60 of the upper housing 12 pushes the main body 32 of the bottle 30 in the direction of arrow A'. Thus, the nozzle 34 is compressed into the base 36 within the nozzle opening 40, thereby causing pepper spray within the main body 32 to eject through the nozzle 34 and out through the nozzle opening 40. As shown, the nozzle 34 is not bent or pivoted with respect to the base 36 or the remainder of the bottle 30. Instead, the nozzle remains longitudinally aligned with respect to a central axis of the bottle 30.

Therefore, in order to dispense pepper spray, a user pushes down on the activation button and then slides it forward in the direction of the intended discharge (i.e., toward the target). Such movement is intuitive as it is toward the target. Further, this two-stage movement protects against inadvertent discharge. Simply pushing the button down does not result in a discharge. Consequently, the assembly 10 accidently brushing up against another object does not cause pepper spray to be discharged.

Once pressure to the activation button 16 is released, the stored energy of the compressed bottle 30 forces the upper housing 12 back in the direction of arrow A. Consequently, the safety tab 64 retreats back through the tab slot 44, and the activation button 16 springs back through the opening 18. The lock tab 58 prevents the upper housing 12 from shifting off the lower housing 14 when it is urged into the planar beam 54 defining the slot 56.

Figure 16:
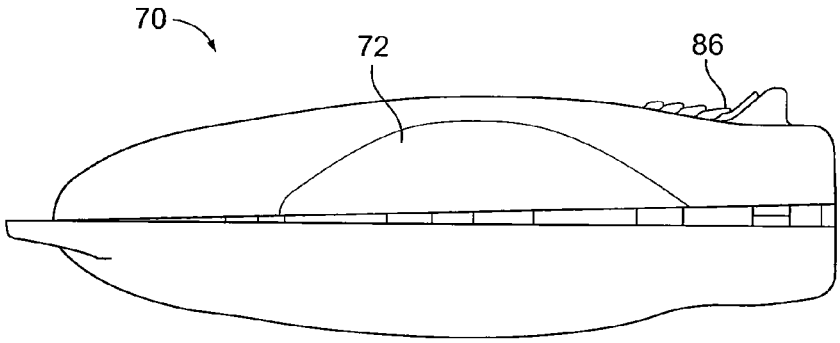
FIG. 16 illustrates a lateral view of a pepper spray container assembly, according to an embodiment of the present invention.
Figure 17:
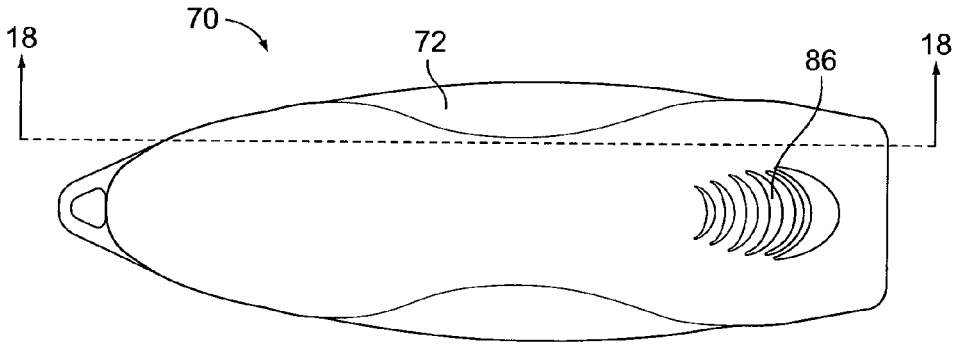
FIG. 17 illustrates a top view of a pepper spray container assembly, according to an embodiment of the present invention.

FIGS. 16 and 17 illustrate lateral and top views, respectively, of a pepper spray container assembly 70, according to an embodiment of the present invention. The assembly 70 is similar to the assembly 10. The assembly 70 includes an upper housing 72 slidably secured to a lower housing 74.

Figure 18:
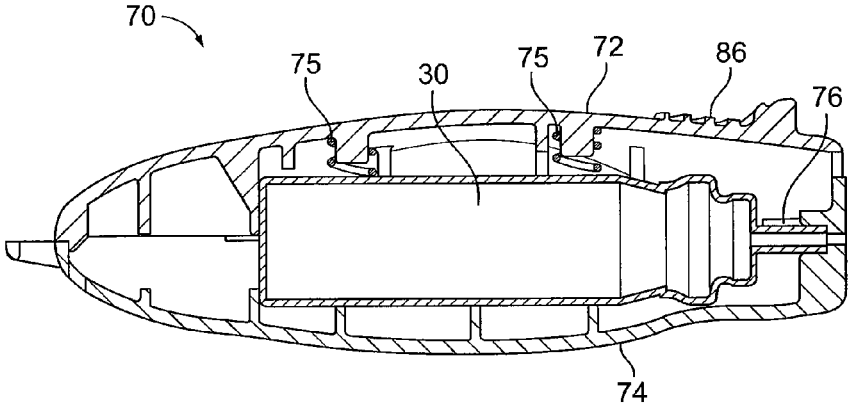
FIG. 18 illustrates a lateral cross-sectional view of a pepper spray container assembly through line 18-18 of FIG. 17, according to an embodiment of the present invention.

FIG. 18 illustrates a lateral cross-sectional view of the pepper spray container assembly 70 through line 18-18 of FIG. 17. A pepper spray can 30 is retained within the upper and lower housings 72 and 74. Coil springs 75 are positioned between a top wall of the upper housing 72 and the pepper spray bottle 30. The coil springs 75 provide a spring constant that forces the upper housing 72 to be separated from the lower housing 74 by a gap 76. That is, the springs 75 force the upper housing 72 away from the lower housing 74. The force constant is overcome through a user engaging the button 86 and pressing it down.

Figure 19:
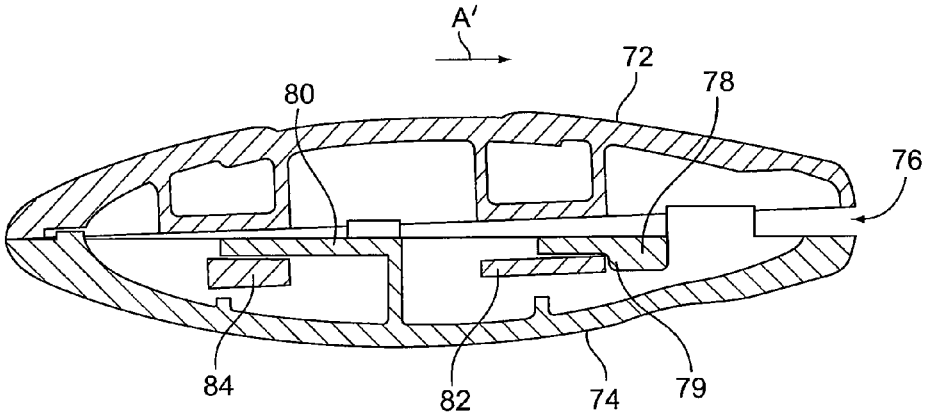
FIG. 19 illustrates a lateral cross-sectional view of an upper housing secured to a lower housing in disengaged position, according to an embodiment of the present invention.

FIG. 19 illustrates a lateral cross-sectional view of the upper housing 72 secured to the lower housing 74 in a disengaged position. For the sake of clarity, the pepper spray can 30 is not shown. As shown in FIG. 19, the upper housing 72 is separated from the lower housing 74 by a gap 76 (produced by the action of the coil springs 75). The lower housing 74 includes lock ledges 78 and 80 that latchably engage ledges 82 and 84 extending downwardly from the upper housing 72. The leading lock ledge 78 includes a lower protuberance 79 proximate the leading edge of the ledge 82 that prevents the ledge 82, and therefore the upper housing 72, from shifting forward in the direction of arrow A'.

Figure 20:
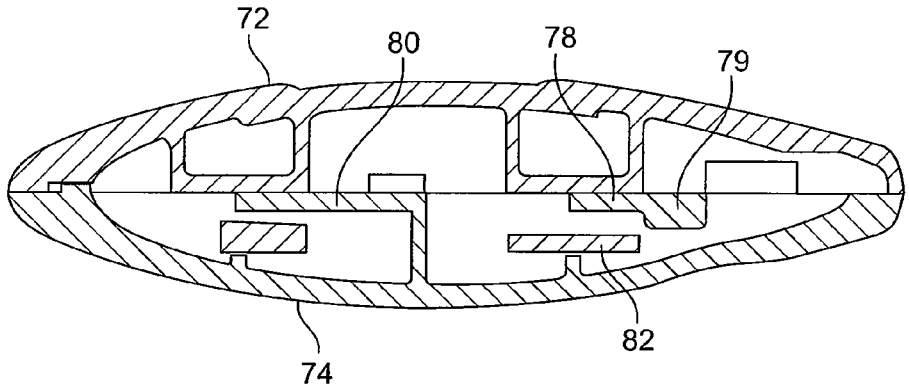
FIG. 20 illustrates a lateral cross-sectional view of an upper housing secured to a lower housing in a depressed position, according to an embodiment of the present invention.

FIG. 20 illustrates a lateral cross-sectional view of the upper housing 72 secured to a lower housing 74 in a depressed position, according to an embodiment of the present invention. In order to disperse the pepper spray, the button 86 (shown in FIGS. 16-18 is pressed down, thereby compressing the upper housing 72 into the lower housing 74. During this movement, the ledges 82 and 84 are removed from an abutting engagement with the lock ledges 78 and 80, respectively. As shown in FIG. 20, the ledge 82 moves away from the lock ledge 78 such that it is no longer blocked from forward movement by the protuberance 79.

Figure 21:
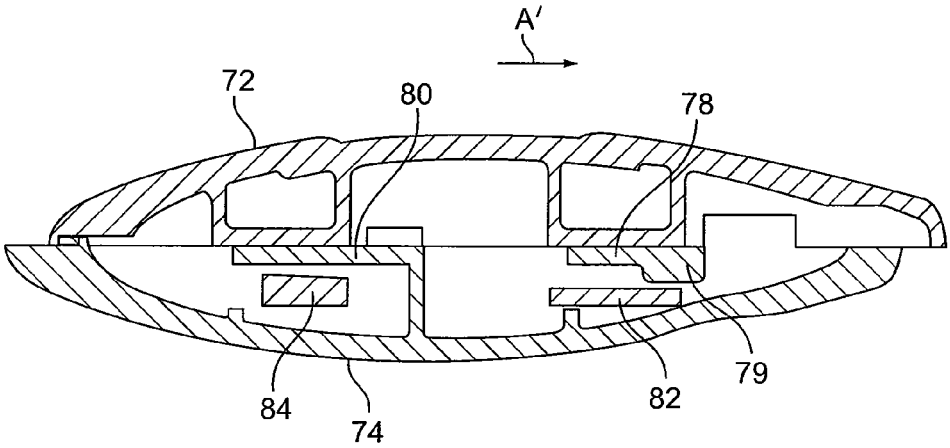
FIG. 21 illustrates a lateral cross-sectional view of an upper housing secured to a lower housing in a fully-engaged position, according to an embodiment of the present invention.

FIG. 21 illustrates a lateral cross-sectional view of the upper housing 72 secured to the lower housing 74 in a fully-engaged position, according to an embodiment of the present invention. Once the ledge 82 is removed from an abutting relationship with the lock ledge 78, the upper housing 72 may be moved forward in the direction of arrow A' in order to dispense the pepper spray, similar to the process described above with respect to the assembly 10. After pressure is released from the activation button 86, the pepper spray bottle 30 returns the upper housing 72 to its at-rest position, as described above with respect to the assembly 10. The springs 75 (shown in FIG. 18) urge the upper housing 72 away from the lower housing 74 until the ledges 82 and 84 abut into the lock ledges 78 and 80, respectively.

Figure 22:
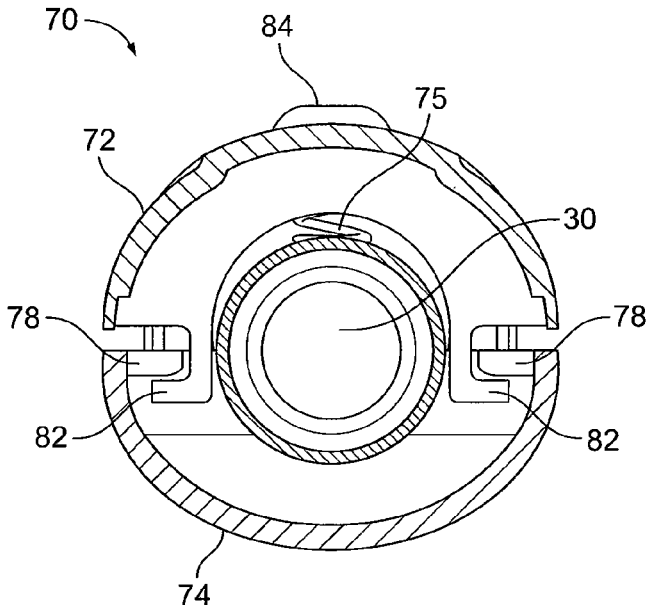
FIG. 22 illustrates an axial cross-sectional view of a pepper spray container assembly, according to an embodiment of the present invention.

FIG. 22 illustrates an axial cross-sectional view of the pepper spray container assembly 10. As shown, the springs 75 ensure that the ledges 82 are urged into the lock ledges 78. When the upper housing 72 is slid forward with respect to the lower housing 74, the springs 75 slide longitudinally over the main body of the pepper spray bottle 30.

Figure 23:
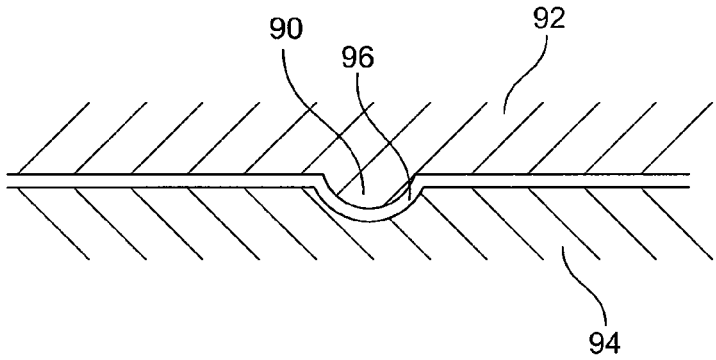
FIG. 23 illustrates a simplified lateral view of a securing detent, according to an embodiment of the present invention.

FIG. 23 illustrates a simplified lateral view of a securing detent 90, according to an embodiment of the present invention. The securing detent 90 may be used in conjunction with, or in lieu of, the securing members discussed above.

An upper housing 92, such as the upper housings discussed above, may include the securing detent 90 (as opposed to the ledges and locking ledges discussed above) therein. The securing detent 90 may fit into a reciprocal opening 96 formed in the lower housing 94. Optionally, the securing detent 90 may be within the lower housing 94, while the opening 96 may be within the upper housing 92. As shown in FIG. 23, the detent 90 is biased to the closed position. To overcome the bias, a user engages the upper housing 92 as discussed above and slides it forward, thereby overcoming the biasing force of the detent 90 (that is, removing the detent 90 from the opening 96), and allowing pepper spray to be dispersed. In other words, the securing detent 90 protects against unintended discharge of pepper spray as with the embodiments discussed above.

The securing detent 90 may be semi-circular and fit into a reciprocal opening 96. However, the securing detent 90 may be any shape.

Embodiments of the present invention may be any size or shape. While the assemblies are shown as elliptical, the assemblies may be rectangular, for example. Embodiments of the present invention are in no way limited to the specific shapes and sizes shown in the Figures.

Embodiments of the present invention provide a pepper spray container assembly that protects against unintended discharge. The embodiments discussed above allow a user to discharge pepper spray through a two-stage process in which a user first pushes down, and then slides a portion of the assembly forward toward an intended target.

While various spatial and directional terms, such as top, bottom, lower, mid, lateral, horizontal, vertical, front and the like may used to describe embodiments of the present invention, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

The invention claimed is:

1. A pepper spray container assembly comprising:
a first housing including an activation button;
a second housing secured to said first housing; and
a pepper spray bottle securely retained by said first and second housings, wherein said activation button is configured to be pressed into the assembly and moved forward toward an intended target, thereby sliding said first housing forward relative to said second housing, in order to dispense pepper spray from said pepper spray bottle.

2. The assembly of claim 1, wherein said pepper spray bottle comprises a main body and a nozzle portion.

3. The assembly of claim 2, wherein said nozzle portion is longitudinally compressed when said activation button is moved forward.

4. The assembly of claim 2, wherein said nozzle portion remains longitudinally aligned with respect to a central axis of said pepper spray bottle at all times.

5. The assembly of claim 1, wherein at least one of said first and second housings comprises a detachable key ring.

6. The assembly of claim 1, wherein said first housing comprises a safety tab integrally connected to said activation button, wherein said safety tab abuts a wall portion of said second housing in a deactivated position, and wherein said safety tab is aligned with and slides through a tab slot formed in said wall portion when said activation button is pressed into the assembly and moved forward.

7. The assembly of claim 1, wherein said first housing comprises first slider tabs, wherein said second housing comprises second slider tabs, and wherein said first and second slider tabs slidably abut one another to secure said first housing to said second housing.

8. The assembly of claim 1, wherein one of said first and second housings comprises a lock tab, and wherein the other of said first and second housings comprises a lock tab slot that securely retains said lock tab.

9. The assembly of claim 1, wherein one of said first and second housings comprises lock ledges, and wherein the other of said first and second housings comprises securing ledges that are biased into said lock ledges, thereby securing said first housing to said second housing.

10. The assembly of claim 9, wherein at least one of said lock ledges comprises a protuberance that prevents at least one of said securing ledges from forward movement when the assembly is in a deactivated position.

11. The assembly of claim 1, comprising at least one biasing spring between one of said first and second housings and said pepper spray bottle.

12. The assembly of claim 1, wherein one of said first and second housings comprises a detent, and wherein the other of said first and second housing comprises a reciprocal opening that retains said detent when the assembly is in a deactivated position.

13. A pepper spray container assembly comprising:
a first housing;
a second housing secured to said first housing; and
a pepper spray bottle securely retained by said first and second housings, wherein a portion of said first housing is configured to be pressed into the assembly and moved forward into an activation position, thereby sliding said first housing forward relative to said second housing, wherein an entirety of said pepper spray bottle remains longitudinally aligned with respect to said first and second housings in the activation position.

14. A pepper spray container assembly comprising:

a first housing including an activation button and a safety tab integrally connected to said activation button;

a second housing secured to said first housing, wherein a bottle chamber is defined between said first and second housings, wherein at least one of said first and second housings comprises a detachable key ring, wherein one of said first and second housings comprises a lock tab, and wherein the other of said first and second housings comprises a lock tab slot that securely retains said lock tab; and a pepper spray bottle comprising a main body and a nozzle portion, wherein said pepper spray bottle is contained within said bottle chamber, wherein said activation button is configured to be pressed into the assembly and moved forward toward an intended target, thereby sliding said first housing with respect to said second housing, in order to dispense pepper spray from said pepper spray bottle, wherein said nozzle portion is longitudinally compressed when said activation button is moved forward, wherein said safety tab abuts a wall portion of said second housing when the assembly is in a deactivated position, and wherein said safety tab is aligned with and slides through a tab slot formed in said wall portion when said activation button is pressed into the assembly and moved forward.

15. The assembly of claim 14, wherein said nozzle portion is not angled with respect to said main body when said activation button is moved forward.

16. The assembly of claim 14, wherein said nozzle portion remains longitudinally aligned with respect to a central axis of said pepper spray bottle at all times.

17. The assembly of claim 14, wherein said first housing comprises first slider tabs, wherein said second housing comprises second slider tabs, and wherein said first slider tabs slidably abut one another to secure to first housing to said second housing.

18. The assembly of claim 14, wherein one of said first and second housings comprises lock ledges, and wherein the other of said first and second housings comprises securing ledges that are biased into said lock ledges, thereby securing said first housing to said second housing.

19. The assembly of claim 18, wherein at least one of said lock ledges comprises a protuberance that prevents at least one of said securing ledges from forward movement when the assembly is in a deactivated position.

20. The assembly of claim 14, comprising at least one biasing spring between one of said first and second housings and said pepper spray bottle.

21. The assembly of claim 14, wherein one of said first and second housings comprises a detent, and wherein the other of said first and second housing comprises a reciprocal opening that retains said detent when the assembly is in a deactivated position.

* * * * *